US011891224B2

(12) United States Patent
Ames

(10) Patent No.: US 11,891,224 B2
(45) Date of Patent: Feb. 6, 2024

(54) VESSEL LID AND METHODS OF MAKING AND USING SAME

(71) Applicant: REAL VALUE LLC, Norman, OK (US)

(72) Inventor: Micah Ames, Oklahoma City, OK (US)

(73) Assignee: Real Value LLC, Moore, OK (US)

( * ) Notice: Subject to any disclaimer, the term of this patent is extended or adjusted under 35 U.S.C. 154(b) by 0 days.

(21) Appl. No.: 16/439,382

(22) Filed: Jun. 12, 2019

(65) Prior Publication Data

US 2020/0391913 A1 Dec. 17, 2020

(51) Int. Cl.

| | |
|---|---|
| ***B65D 51/18*** | (2006.01) |
| ***B65D 43/02*** | (2006.01) |
| ***B65D 47/12*** | (2006.01) |
| ***B65D 53/02*** | (2006.01) |
| ***B65D 55/02*** | (2006.01) |

(Continued)

(52) U.S. Cl.

CPC ..... *B65D 51/18* (2013.01); *A45F 3/08* (2013.01); *B65D 43/0229* (2013.01); *B65D 47/121* (2013.01); *B65D 51/242* (2013.01); *B65D 53/02* (2013.01); *B65D 55/02* (2013.01); *B65D 2251/0025* (2013.01); *B65D 2251/0081* (2013.01)

(58) Field of Classification Search

CPC .... B65D 51/18; B65D 47/121; B65D 47/122; B65D 47/123; B65D 43/0229; B65D 2251/0025; B65D 2251/0081; B65D 2251/0018; B65D 2251/0087; B65D 51/242; B65D 47/125; B65D 47/126; B65D 39/10

See application file for complete search history.

(56) References Cited

U.S. PATENT DOCUMENTS 3,680,745 A * 8/1972 Landen ..... B65D 47/125 222/570
5,242,085 A * 9/1993 Richter ..... B65D 1/0215 215/12.1

(Continued)

FOREIGN PATENT DOCUMENTS

JP 6346229 B2 3/2018

OTHER PUBLICATIONS

PCT/US2020/037554; "International Search Report and Written Opinion"; dated Aug. 19, 2020; 9 pages.

*Primary Examiner* — John K Fristoe, Jr.
*Assistant Examiner* — Jennifer Castriotta
(74) *Attorney, Agent, or Firm* — Hall Estill Law Firm

(57) ABSTRACT

A lid assembly is connected to a vessel to provide a leak proof seal to prevent leakage of liquid from the vessel. The lid assembly includes a base and a removably connectable lid. The base has an open first end, an open second end and a sidewall. The sidewall defines a passageway which extends between the first and second end of the base. A plurality of projections are provided on an internal surface of the sidewall. The base is removably connected to the vessel. The removably connectable lid of the lid assembly has a stopper configured to be inserted into the open second end of the base. The stopper is provided with a plurality of external projections corresponding to the plurality of projections of the base such that the base and lid are moved between a locked and unlocked position using approximate thirty degree (30°) turns, respectively.

16 Claims, 8 Drawing Sheets

(51) Int. Cl.

| | |
|---|---|
| ***A45F 3/18*** | (2006.01) |
| ***B65D 51/24*** | (2006.01) |
| ***A45F 3/08*** | (2006.01) |

(56) References Cited

U.S. PATENT DOCUMENTS

| | | | | |
|---|---|---|---|---|
| 5,947,318 | A | 9/1999 | Palm | |
| D620,357 | S | 7/2010 | Jewett et al. | |
| D648,177 | S | 11/2011 | Eyal | |
| D664,808 | S | 8/2012 | Dickson, Jr. et al. | |
| D672,238 | S | 12/2012 | Aziz et al. | |
| D672,609 | S | 12/2012 | Aziz et al. | |
| D700,012 | S | 2/2014 | Hurley et al. | |
| D723,333 | S | 3/2015 | Lin | |
| D724,385 | S | 3/2015 | Hurley et al. | |
| D787,935 | S | 5/2017 | Kaiser | |
| D790,920 | S | 7/2017 | Goodwin et al. | |
| D791,579 | S | 7/2017 | Goodwin et al. | |
| D808,220 | S | 1/2018 | Burns et al. | |
| D809,920 | S | 2/2018 | Maple | |
| D810,504 | S | 2/2018 | Goodwin et al. | |
| D811,818 | S | 3/2018 | Wu | |
| D812,428 | S | 3/2018 | Wu | |
| D815,908 | S | 4/2018 | Kauss et al. | |
| D822,439 | S | 7/2018 | Spivey et al. | |
| 2002/0179605 | A1 | 12/2002 | Miani et al. | |
| 2006/0163190 | A1* | 7/2006 | Laveault | B65D 47/125 215/44 |
| 2010/0155358 | A1 | 6/2010 | George | |
| 2014/0263324 | A1* | 9/2014 | Latham | B65D 51/18 220/259.1 |
| 2015/0282654 | A1 | 10/2015 | Kurabe et al. | |
| 2018/0362225 | A1* | 12/2018 | Davies | A45F 3/16 |
| 2019/0099042 | A1 | 4/2019 | Leppert et al. | |
| 2019/0152655 | A1* | 5/2019 | Lake | B65D 81/3846 |

* cited by examiner

VESSEL LID AND METHODS OF MAKING AND USING SAME

FIELD OF THE INVENTION

The present invention relates generally to a lid for sealing liquid in a vessel, and more particularly, but not by way of limitation, to an improved vessel lid and methods of making and using the vessel lid.

BACKGROUND OF THE INVENTION

Lids are well known for covering the opening of a vessel to prevent a liquid in the vessel from spilling out or for helping to maintain the proper temperature of the liquid. A lid allows an individual to store the liquid in the vessel and to transport liquid without spillage. There are many lids on the market for covering the opening of a vessel. A need was identified to create a lid which better seals the opening of a vessel and allows for easier addition and removal of a lid to a vessel.

To this end, although vessel lids of the existing art are operable, further improvements are desirable and a need remains to provide a lid for a vessel and method of use whereby the vessel lid is constructed in such a manner that it will allow for easier addition and removal of a lid to a vessel and still sealing the opening of a vessel and thus preserve such liquid in the vessel and allow for an individual to carry such liquid without spillage. It is to such a vessel lid, and method of making and using, that at least one embodiment of the present invention is directed.

DETAILED DESCRIPTION OF THE INVENTION

Figure 1:
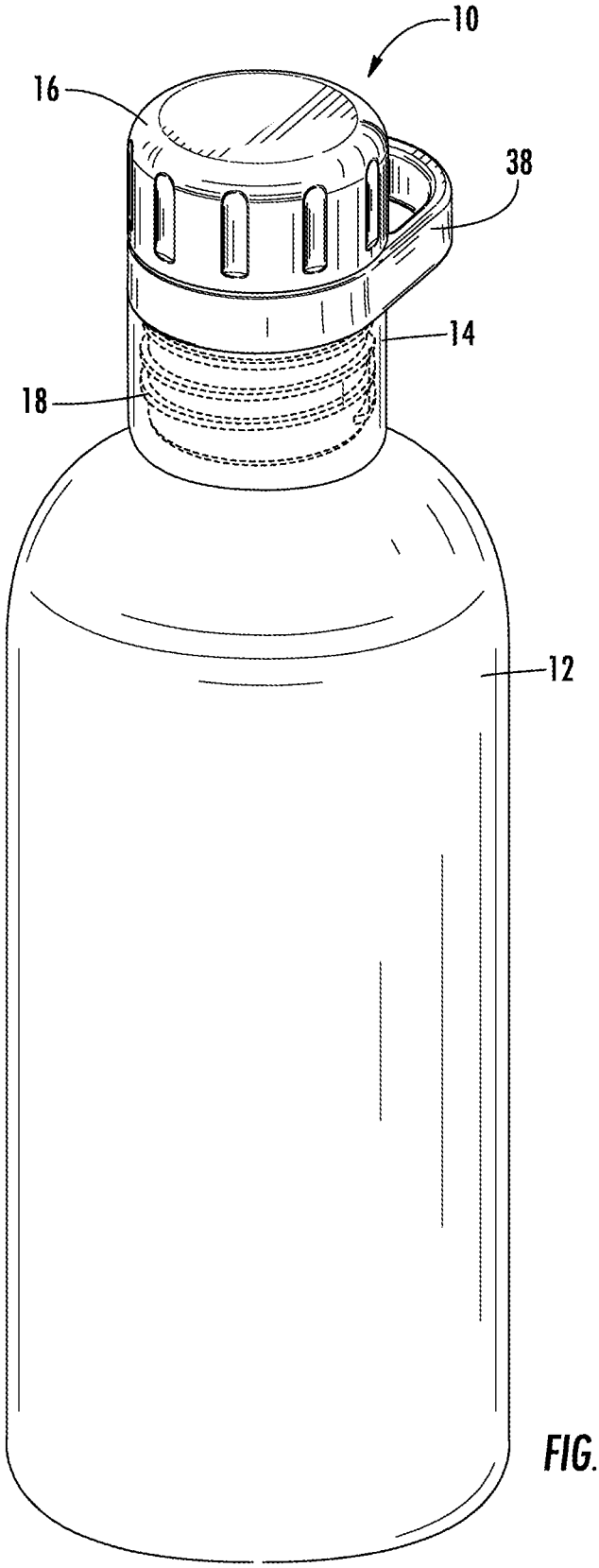
FIG. 1 is a perspective view of one embodiment of a lid assembly mounted on a vessel, the lid assembly constructed in accordance with the present disclosure.
Figure 2:
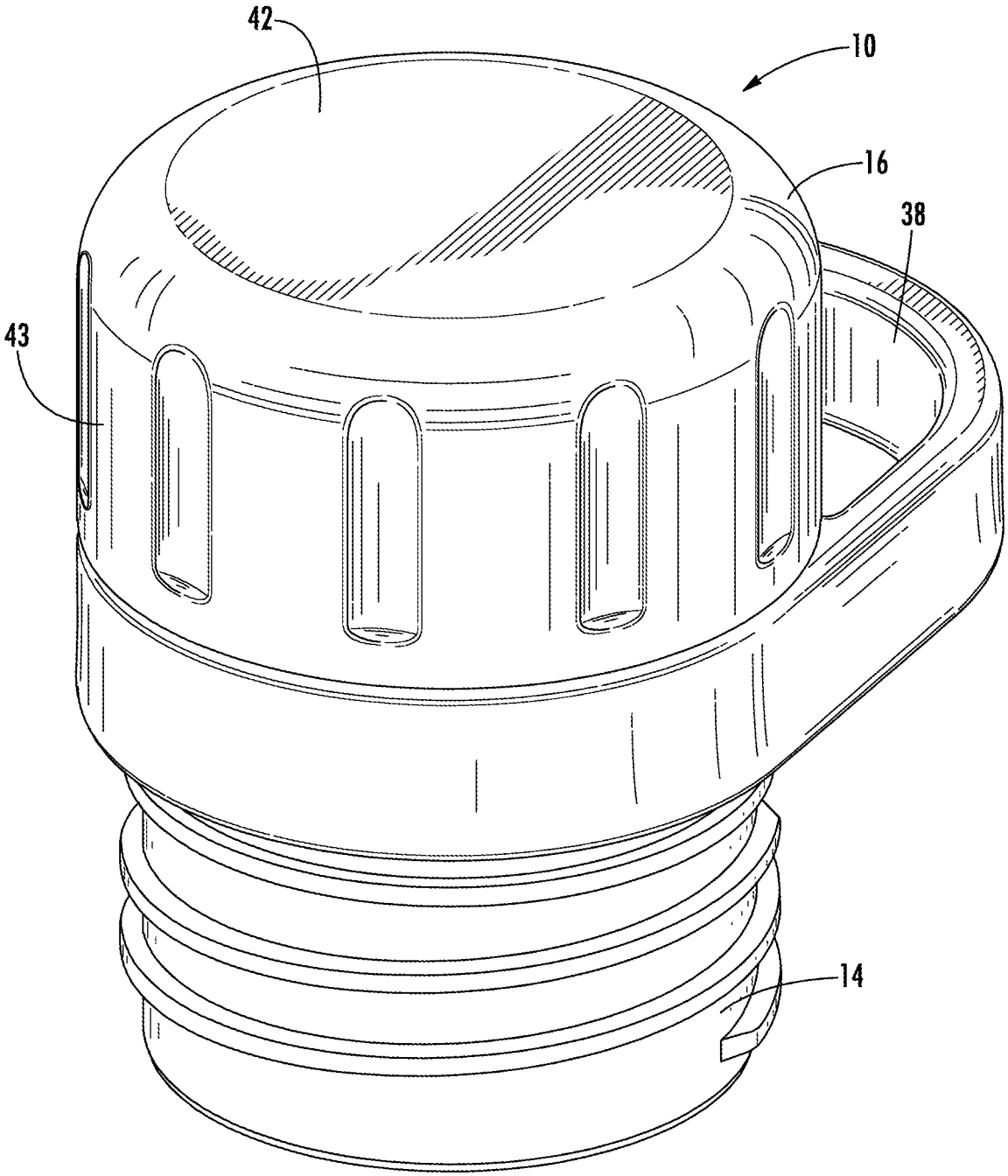
FIG. 2 is a perspective view of the lid assembly of FIG. 1.
Figure 3:
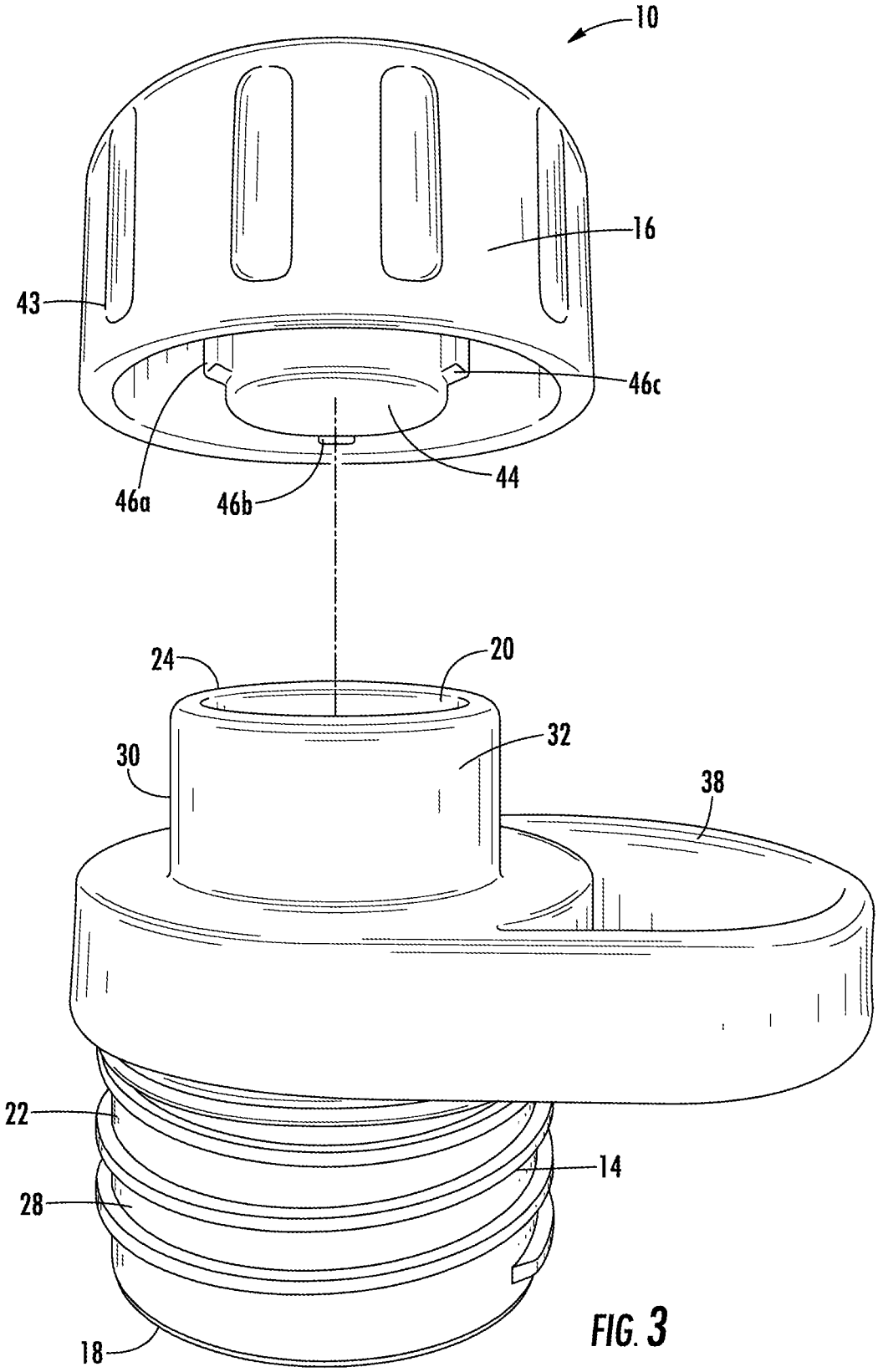
FIG. 3 is an exploded view of the lid assembly of FIG. 1, the lid assembly having a base and a connectably removable lid.
Figure 4A:
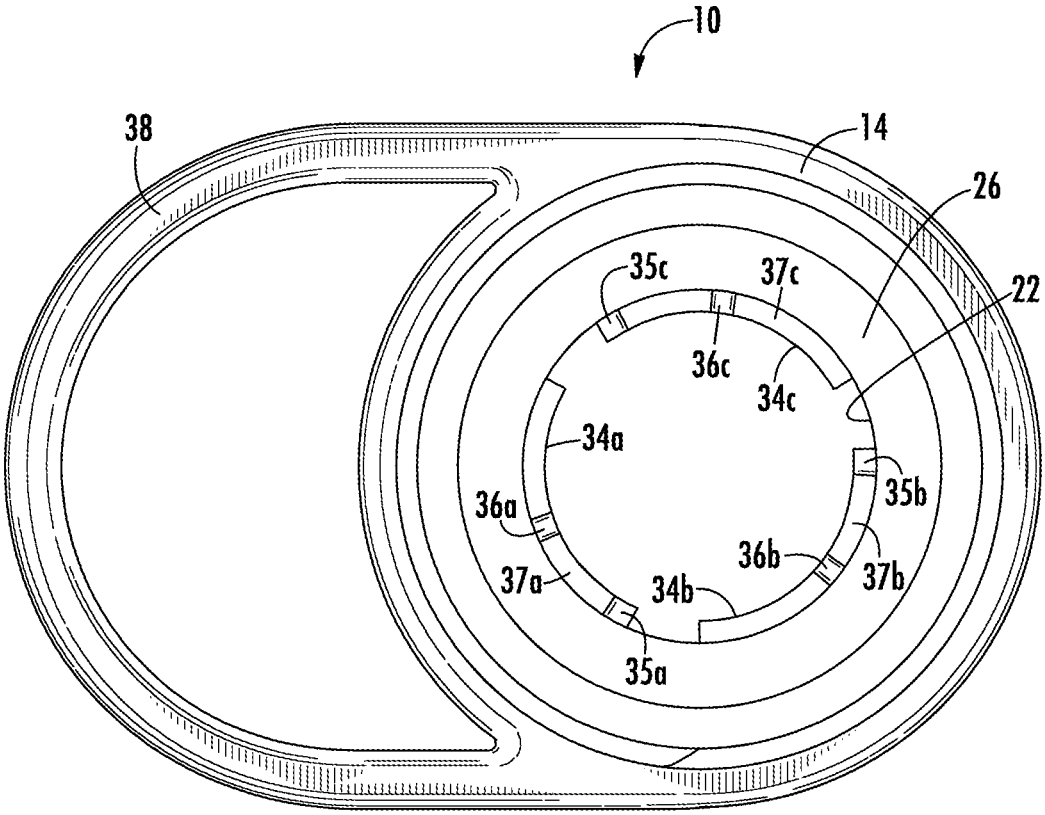
FIG. 4*a* is a top view of the base of the lid assembly of FIG. 3.
Figure 4B:
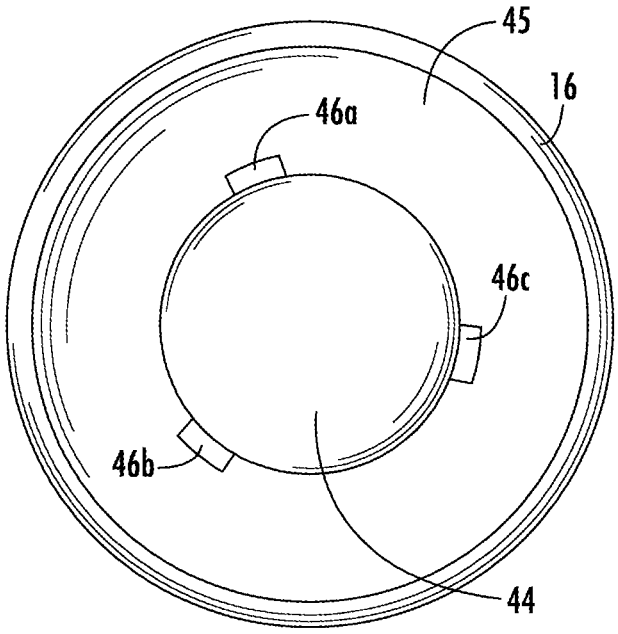
FIG. 4*b* is a bottom view of the connectably removable lid of the lid assembly of FIG. 3.
Figure 5:
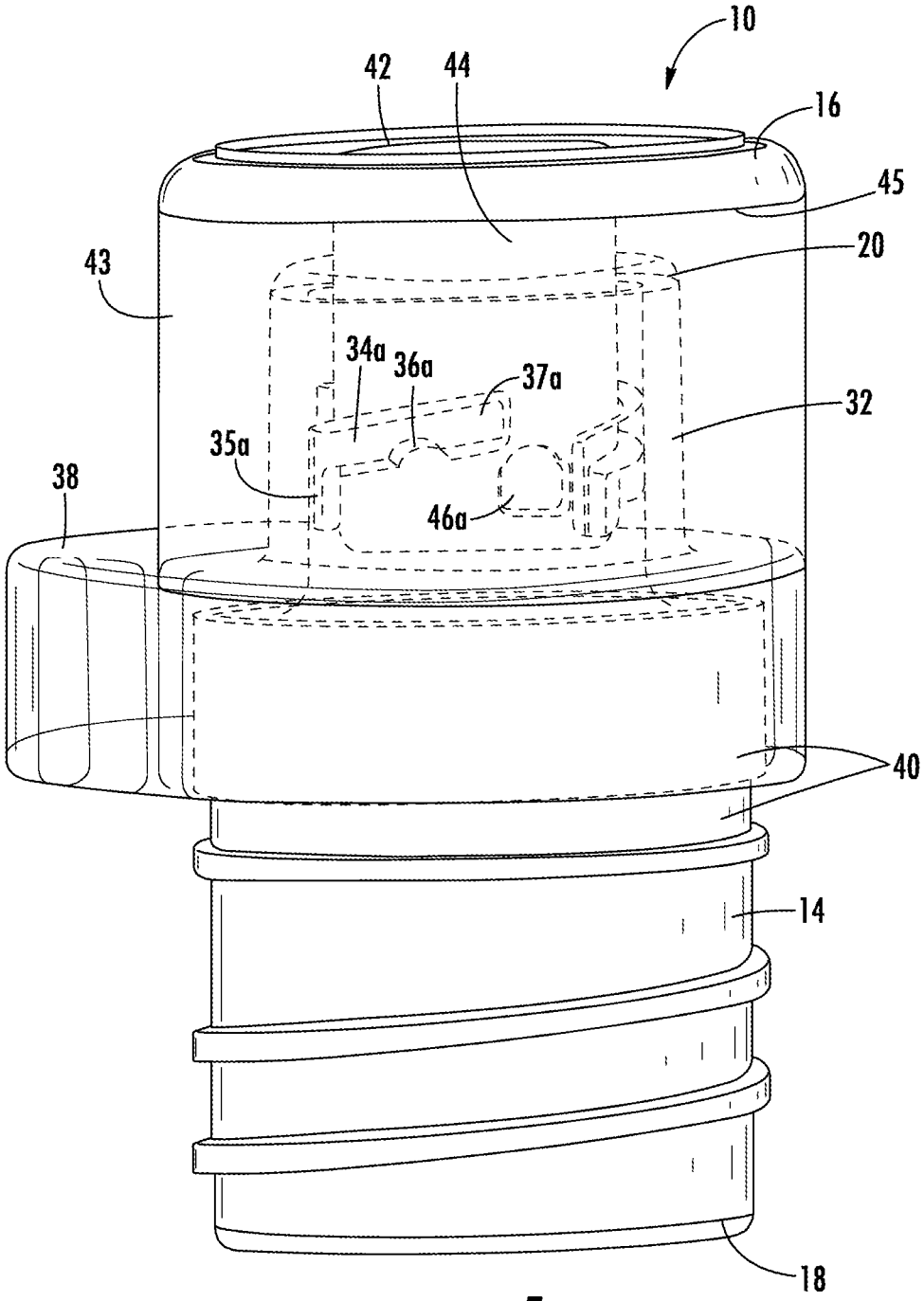
FIG. 5 is a perspective view showing the lid assembly of FIG. 3 in an unlocked position.
Figure 6:
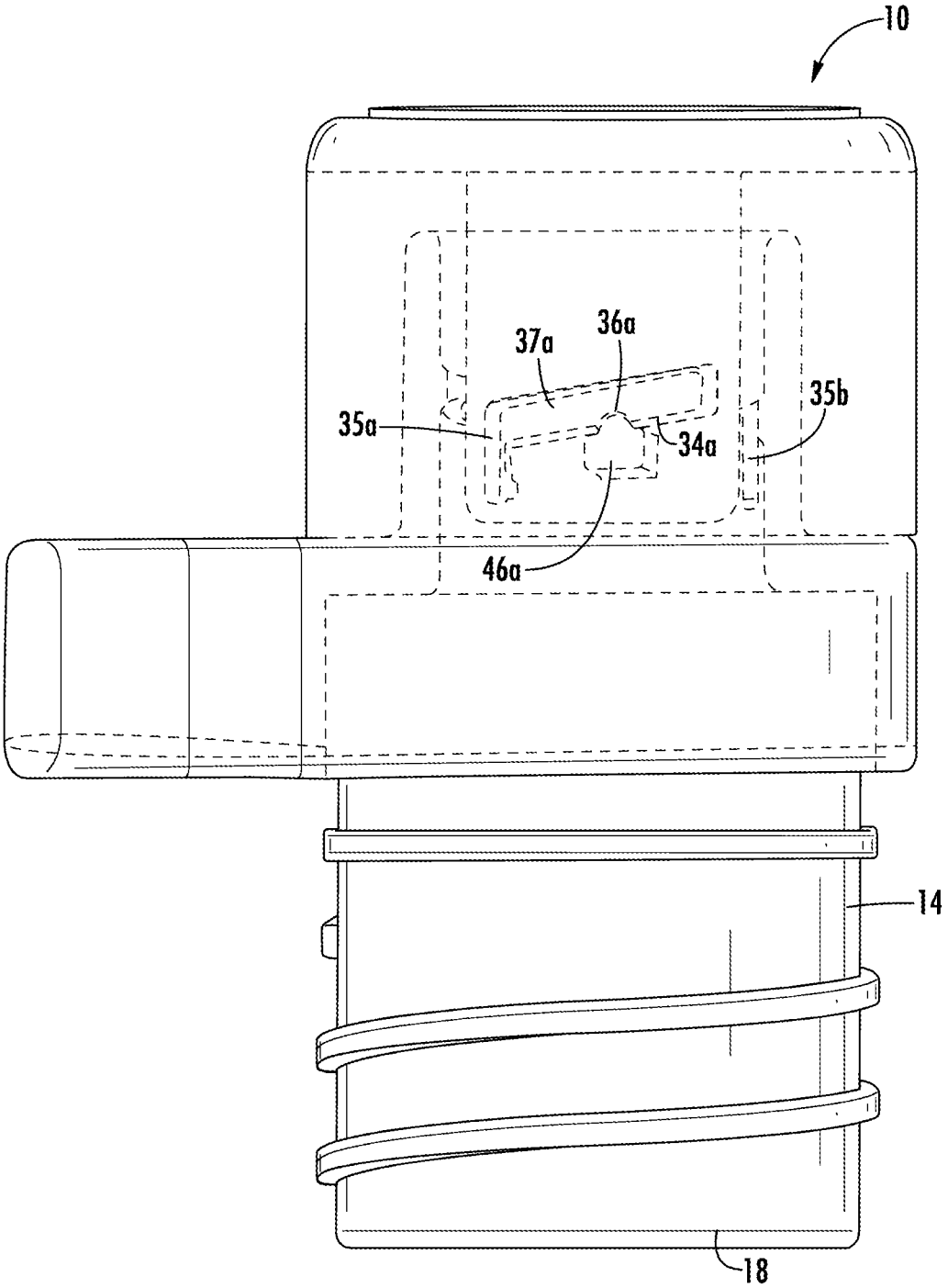
FIG. 6 is a perspective view showing the lid assembly of FIG. 3 in a locked position.

Referring now to the drawings, and more particularly to FIG. 1, one embodiment of a lid assembly 10 is shown connected to a vessel 12 constructed in accordance with the present disclosure. The vessel 12 is shown in FIG. 1 as a bottle, however, it should be understood by one of ordinary skill in the art that the lid assembly 10 may be sized and configured to be utilized with any type and shape of vessel depending on the size and shape of the vessel for use with the lid assembly 10 so long as the lid assembly functions in accordance with the present disclosure as described herein.

The lid assembly 10 may be constructed from any material known by one of ordinary skill in the art which is strong and durable enough to cover an opening of a vessel, such as, polymeric materials, stainless steel, aluminum, silicone, or combinations thereof, or other such materials capable of being utilized in the construction of the lid assembly 10. It should be understood by one of ordinary skill in the art that the lid assembly 10 may be any variety of shapes, such as circular, square, cylindrical, coned, or the like, so long as the lid assembly 10 functions in accordance with the present disclosure as described herein. It is contemplated, in one embodiment, that portions of the lid assembly 10 are constructed as one piece, however, it should be understood that the lid assembly 10 may be constructed from various components, from multiple pieces of material, or from combinations thereof.

Referring now to FIGS. 1-6, broadly, the lid assembly 10 includes a base 14 and a removably connectable lid 16. The base 14 which is removably connectable to the vessel 12 has an open bottom first end 18, an open second end 20 and a sidewall 22 defining a passageway 24 extending between the first end 18 and the second end 20. The passageway 24 being used for giving or receiving the liquid/fluid to/from the vessel 12. The open first end 18 is externally threaded so as to facilitate connection with an inner portion of the vessel 12 which has corresponding internal threading.

Figure 7:
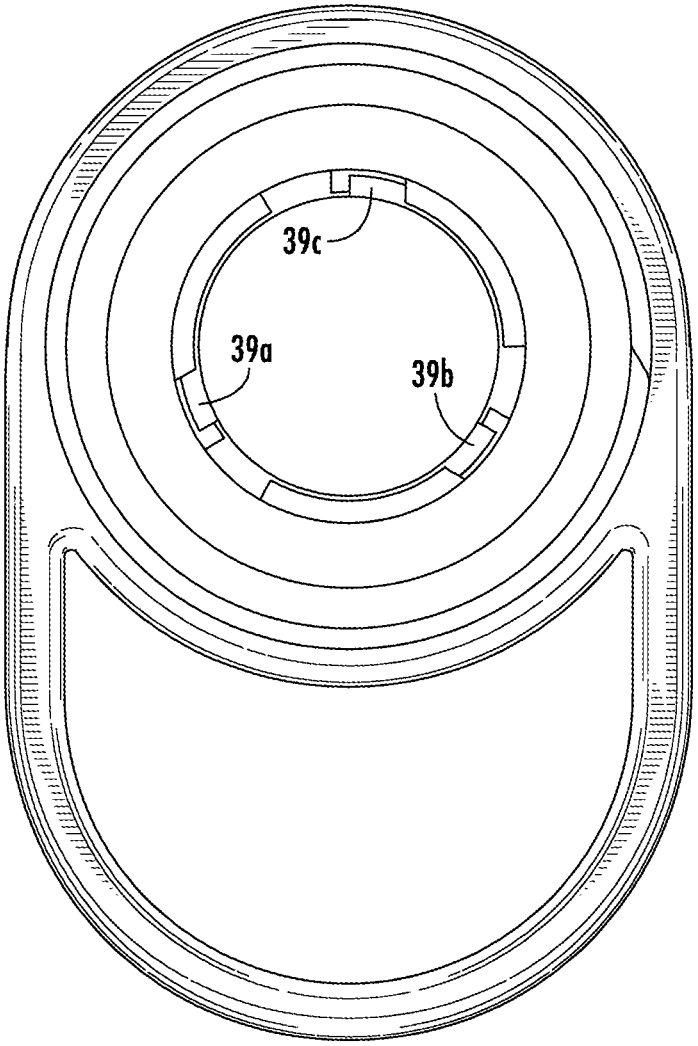
FIG. 7 is a top view of a base of another embodiment of a lid assembly.

An internal shoulder 26 is positioned in the passageway 24 between the first end 18 and the second end 20 of the base 14 so as to provide the base 14 with a first portion 28 and a second portion 30. The first portion 28 of the base 14 has a diameter greater than that of the second portion 30 of the base 14, by way of example, such that the second portion 30 of the base 14 forms a collar 32 extending upward from the sidewall 22 for giving or receiving the lid 16. In another embodiment, the collar extends from a handle 38. A plurality of substantially horizontally slanted L-shaped projections 34 (*a-c*) are positioned in a staggered arrangement on the internal sidewall 22 of the second portion 30 of the base 14. Each projection 34 (*a-c*) includes a vertical portion 35 (*a-c*) and a substantially horizontally slanted portion 37 (*a-c*). Although the plurality of projections 34 are discussed herein as being substantially horizontally-slanted L-shaped, it should be understood by one of ordinary skill in the art that the plurality of projections 34 may be any size, shape, angle or configuration so long as the plurality of projections 34 function in accordance with the present disclosure. Further, it should be understood that the plurality of projections may also be arranged in a variety of other ways such as aligned, uniform and the like, so long as the plurality of projections function in accordance with the present disclosure as described herein. Each of the plurality of projections 34 is provided with a notch 36 (*a-c*). The notch 36 is positioned on the substantially horizontally slanted portion 37 of the each of the projections 34. In another embodiment the plurality of projections 34 are configured to form a seat 39 (*a-c*) (FIG. 7).

The substantially u-shaped handle 38 is positioned between the first portion 28 and the second portion 30 of the base 14 for carrying the vessel 12. It should be understood by one of ordinary skill in the art that any shaped and sized handle may be utilized so long as the handle functions in accordance with the present disclosure. Additionally, although the presented embodiment depicts the lid assembly with a handle, it should be understood by one of ordinary skill in the art that the lid assembly may be created without a handle.

A seal ring 40 is positioned about the first portion 28 of the base 14 to make a sealing engagement with the vessel 12 to prevent liquid from spilling from the vessel 12 when the lid assembly 10 is connected to the vessel 12.

The lid 16 is provided with a top surface 42 having a skirt 43 extending downward from and about a perimeter of the top surface 42 of the lid. A stopper 44 extends downward from a bottom surface 45 of the lid 16. In one embodiment, the stopper 44 is provided as an insert to the lid 16. The stopper 44 is configured to be inserted into the open second end 20 of the base 14. The stopper 44 is provided with a plurality of external rectangular projections 46 (*a-c*) in a staggered arrangement about the stopper 44. It should be understood that the plurality of projections may be different shapes and may also be arranged in a variety of other ways such as aligned, uniform and the like, so long as the plurality of projections function in accordance with the present disclosure as described herein. Each of the plurality of projections 46 (*a-c*) of the lid 16 correspond with each of the plurality of the projections 34 of the internal sidewall 22 of the second portion 28 of the base 14 so as to lock and unlock the lid 16 in relation to the base 14 of the lid assembly 10.

In the unlocked position (FIG. 5), the stopper 44 of the lid 16 is inserted into the open second end 20 of the base 14 of the lid assembly 10. The plurality of projections 46 of the lid 16 are positioned such that they may be aligned adjacent to the plurality of the projections 34 of the base 14 such that the lid 16 can be inserted and removed from the open second end 20 of the base of lid assembly 10 without turning the lid 16. The plurality of the substantially horizontally-slanted L-shaped projections 34 are longer in length than the plurality of projections 46. To lock the lid 16 to the base 14, the lid 16 is turned approximately thirty degrees (30°) in a first direction so that each of the plurality of projections 46 are locked in position by being moved to the notch 36 of their corresponding plurality of projections 34 or, in another embodiment, are positioned adjacent the seat 39 (FIG. 7). In the locked position (FIG. 6), a leak proof seal is formed between the base 14 and the lid 16. To unlock the lid 16 from the base 14, the lid 16 is turned approximately thirty degrees (30°) in a second direction so that each of the plurality of projections 46 are moved in a position away from the seat/notch 36 of each of the plurality of projections 34 so that the plurality of projections 46 of the lid 16 are again aligned adjacent to the plurality of the projections 34 of the base 14 and the lid 16 may be removed from the base 14. In various embodiments, the lid 16 is turned between a range of 10°-90°.

Figure 8:
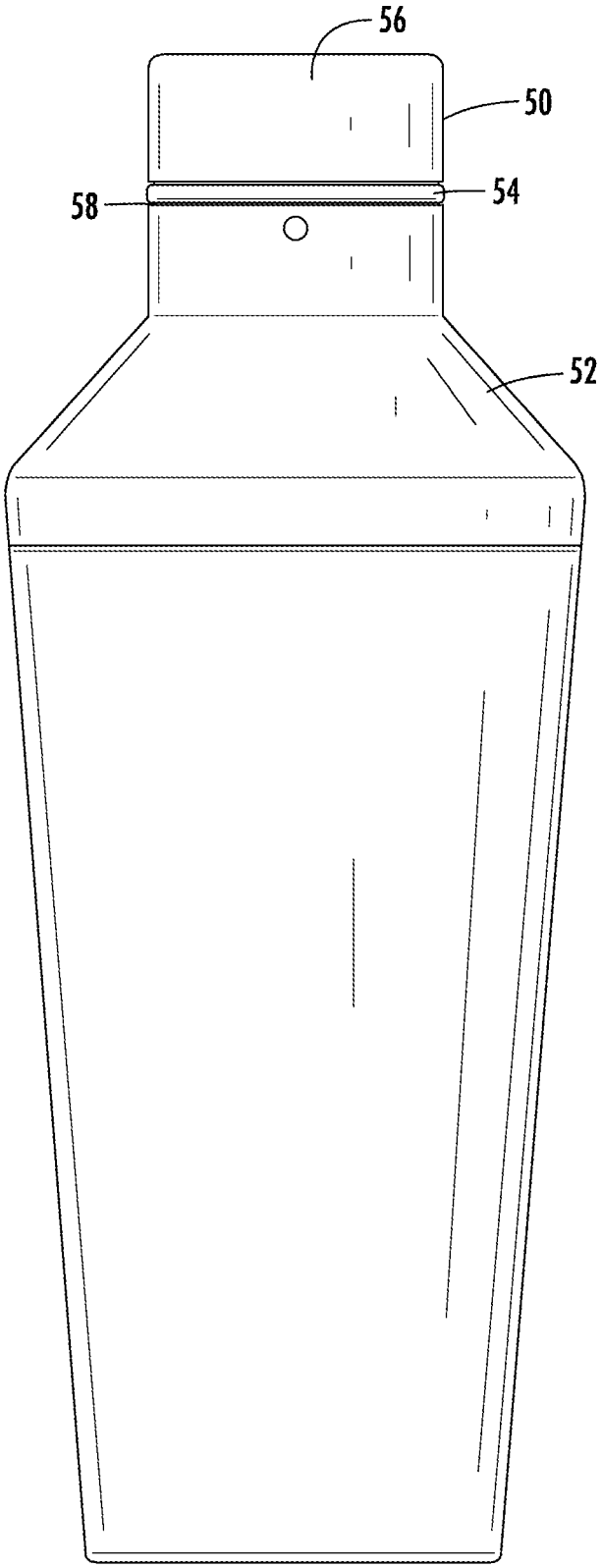
FIG. 8 is a perspective view of another embodiment of a lid assembly attached to a different vessel.

Referring to FIG. 8, another embodiment of a lid assembly 50 is shown attached to a container 52. The lid assembly 50 is the same as the lid assembly 10 except that the lid assembly 50 does not have a handle. Broadly, the lid assembly 50 includes a base 54 and a removably connectable lid 56. The lid assembly 50 functions the same as lid assembly 10 and is removably attached to the container 52 in the same way that lid assembly 10 is removably attached to the vessel 12. An open end 58 of the lid assembly 50 is externally threaded so as to facilitate connection with an inner portion of the container 52 which has corresponding internal threading.

In use, the base 14 of the lid assembly 10 threadingly engages inner threads of the vessel 12 so as to connect the base 14 of the lid assembly 10 to the vessel 12. Liquid may be placed in the vessel 12 before or after attachment of the lid assembly 10 to the vessel 12. The stopper 44 of the lid 16 of the lid assembly 10 is inserted into the open second end 20 of the base 14 of the lid assembly 10. The lid 16 of the lid assembly 10 is turned approximately thirty (30°) in a first direction so that the lid 16 of the lid assembly 10 is locked on the base 14 of the lid assembly 10. The lid 16 of the lid assembly 10 is turned approximately thirty degrees (30°) in a second direction to unlock the lid 16 of the lid assembly 10 from the base 14 of the lid assembly 10 so that the lid 16 of the lid assembly 10 may be removed from the base 14 of the lid assembly 10 so that an individual may access the liquid from the vessel 12. In various embodiments, the lid 16 is turned between a range of 10°-90°.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. A lid assembly connectable to a vessel, comprising:

a base having an open first end, an open second end and a sidewall defining a passageway extending between the first and second end, wherein a plurality of L-shaped projections are provided on an internal surface of the sidewall wherein each of the plurality of L-shaped projections is provided with a substantially horizontally slanted portion configured with a notch, and the base is removably connected to the vessel wherein the base is provided with an internal shoulder positioned in the passageway of the base so as to provide the base with a first portion and a second portion wherein the second portion of the base forms a collar; and a lid having a closed top surface, the closed top surface having a skirt extending downward from and about a perimeter of the closed top surface, the skirt positioned over the second portion of the base and a stopper extending downward from a bottom surface of the lid, the stopper configured to be inserted into the collar of the second portion of the base, the stopper being provided with a plurality of external rectangular projections wherein each of the plurality of external rectangular projections is configured to position in the notch of the substantially horizontally slanted portion of the L-shaped projection of the base, such that the plurality of external rectangular projections corresponding to the plurality of L-shaped projections of the base such that the base and lid are moved between a locked and unlocked position wherein each of the plurality of L-shaped projections of the base is provided in a staggered arrangement and each of the corresponding plurality of rectangular projections of the lid are provided in a staggered arrangement.

2. The lid assembly of claim 1 wherein the open first end of the base is externally threaded so as to facilitate connection with the vessel.

3. The lid assembly of claim 1 wherein the first portion of the base has a greater diameter than the second portion of the base.

4. The Rd assembly of claim 3 wherein a seal ring is positioned about the first portion of the base of the Rd assembly to make a sealing engagement when the base of the lid assembly is connected to the vessel.

5. The lid assembly of claim 1, wherein the base is provided with a handle positioned between the first portion and the second portion, the handle being provided for carrying the vessel when the base of the lid assembly is connected to the vessel.

6. The lid assembly of claim 1 wherein in the unlocked position, the stopper of the lid inserted into the open second end of the base of the lid assembly and the plurality of projections of the lid are positioned adjacent to the plurality of the projections of the base such that the lid can be inserted and removed from the open second end of the base of lid assembly without turning the lid.

7. The lid assembly of claim 1 wherein in the locked position, the lid is turned approximately thirty degrees(30°) in a first direction so that each of the plurality of rectangular projections of the lid are locked in position by being moved to the notch of each one of the corresponding plurality of L-shaped projections of the base such that a leak proof seal is formed between the base and the lid.

8. The lid assembly of claim 7 wherein the lid assembly is moved from the locked position to the unlocked position by turning the lid approximately thirty degrees(30°) in a second direction so that each of the plurality of projections of the lid are moved in a position away from the notch of each of the plurality of projections of the base so that the lid may be removed from the base.

9. A lid assembly, comprising:

a base connected to a vessel, the base having an open first end, an open second end and a sidewall defining a passageway extending between the first and second end, wherein a plurality of L-shaped projections are provided on an internal surface of the sidewall wherein each of the plurality of L-shaped projections is provided with a substantially horizontally slanted portion configured with a notch and the base is removably connected to the vessel wherein the base is provided with an internal shoulder positioned in the passageway of the base so as to provide the base with a first portion and a second portion wherein the second portion of the base forms a collar; and a lid having a closed top surface, the closed top surface having a skirt extending downward from and about a perimeter of the closed top surface, the skirt positioned over the second portion of the base and a stopper extending downward from a bottom surface of the lid, the stopper configured to be inserted into the collar of the second portion of the base, the stopper being provided with a plurality of external rectangular projections wherein each of the plurality of external rectangular projections is configured to position in the notch of the substantially horizontally slanted portion of the L-shaped projection of the base, such that the plurality of external rectangular projections corresponding to the plurality of L-shaped projections of the base such that the base and lid are moved between a locked and an unlocked position wherein each of the plurality of L-shaped projections of the base is provided in a staggered arrangement and each of the corresponding plurality of rectangular projections of the lid are provided in a staggered arrangement.

10. The Rd assembly of claim 9 wherein the open first end of the base is externally threaded so as to facilitate connection with the vessel.

11. The lid assembly of claim 9 wherein the first portion of the base has a greater diameter than the second portion of the base.

12. The lid assembly of claim 11 wherein a seal ring is positioned about the first portion of the base of the lid assembly to make a sealing engagement when the base of the lid assembly is connected to the vessel.

13. The lid assembly of claim 9 wherein the base is provided with a handle positioned between the first portion and the second portion, the handle being provided for carrying the vessel when the base of the lid assembly is connected to the vessel.

14. The lid assembly of claim 9 wherein in the unlocked position, the stopper of the lid inserted into the open second end of the base of the lid assembly and the plurality of projections of the lid are positioned adjacent to the plurality of the L-shaped projections of the base such that the lid can be inserted and removed from the open second end of the base of lid assembly without turning the lid.

15. The lid assembly of claim 9 wherein in the locked position, the lid is turned approximately thirty degrees(30°) in a first direction so that each of the plurality of rectangular projections of the lid are locked in position by being moved to the notch of each one of the corresponding plurality of L-shaped projections of the base such that a leak proof seal is formed between the base and the lid.

16. The lid assembly of claim 15 wherein the lid assembly is moved from the locked position to the unlocked position by turning the lid approximately thirty degrees(30°) in a second direction so that each of the plurality of projections of the lid are moved in a position away from the seat/notch of each of the plurality of L-shaped projections of the base so that the lid may be removed from the base.

* * * * *